United States Patent [19]

Rosborough et al.

[11] 3,939,753

[45] Feb. 24, 1976

[54] THREE AXIS COIL MAGNETIC MINESWEEPING SYSTEM

[75] Inventors: Jerry J. Rosborough; William A. Rhyne, both of Panama City, Fla.

[73] Assignee: The United States of America as represented by the Secretary of the Navy, Washington, D.C.

[22] Filed: May 15, 1974

[21] Appl. No.: 470,256

[52] U.S. Cl. ..... 89/1 M; 102/18

[51] Int. Cl.[2] ..... B63G 7/06

[58] Field of Search..... 89/1 M; 102/18; 114/235 R; 244/1 R

[56] References Cited

UNITED STATES PATENTS

| | | | |
|---|---|---|---|
| 2,353,360 | 7/1944 | Ronning | 244/1 R |
| 3,040,658 | 6/1962 | Maltby | 102/18 |
| 3,653,351 | 4/1972 | Martin | 102/18 |
| 3,699,889 | 10/1972 | Cioccio et al. | 102/18 |

*Primary Examiner*—Samuel W. Engle
*Assistant Examiner*—S. A. Cangialosi
*Attorney, Agent, or Firm*—Richard S. Sciascia; Don D. Doty; Harvey A. David

[57] ABSTRACT

A magnetic influence minesweeping system and a method are disclosed wherein three large area air core solenoid coils are arranged with their planes in mutually orthogonal relation. A battery power supply and alternating current pulse generator are utilized to successively energize each coil and generate three magnetic fields having mutually perpendicular principal axes.

4 Claims, 4 Drawing Figures

THREE AXIS COIL MAGNETIC MINESWEEPING SYSTEM

STATEMENT OF GOVERNMENT INTEREST

The invention described herein may be manufactured and used by or for the Government of the United States of America for Governmental purposes without the payment of any royalties thereon or therefor.

FIELD OF THE INVENTION

This invention relates to the destruction of magnetic influence mines by the application of an electrically induced magnetic field, and more particularly to improved magnetic field inducing apparatus that is especially suited for use in triggering magnetic influence mines, irrespective of their orientation, that are disposed on or under the surface of land or in shallow water in locations and conditions that preclude ready accessibility to minesweeping equipment normally towed by helicopters or surface vessels or carried by motor vehicles. Examples of such circumstances include rugged terrain, marshy areas, shallow bays and inlets, areas around bridges and piers, and other restricted areas.

DISCUSSION OF THE PRIOR ART

It has long been known that magnetic influence mines, designed to explode when a vehicle or vessel having a substantial magnetic influence comes into proximity to the mine, can be detonated or swept by an electrically induced magnetic field. The generation of such a field has been accomplished by causing an electrical current flow in a suitable wire coil or solenoid, usually carried in a towed device. One example of this is described in U.S. Pat. No. 2,353,360 to A. Ronning. Such towed devices are, of course, unsuitable for use in the restricted conditions mentioned above.

The effective zone of magnetic influence that can be projected by a solenoid coil is related to its diameter and to the effective ampere-turns in its energization. A small diameter coil, such as is required by the size limitations of a towable package, must be provided with considerable electrical power to effect a satisfactory zone of influence. This electrical power requirement is more readily available from a towing vehicle than it is from portable power sources which must, in many of the restrictive circumstances contemplated for use of this invention, be man carried to the site of operation. Accordingly, it is desirable to provide magnetic field inducing or generating apparatus that requires a minimal amount of power supply equipment, e.g., storage batteries or gasoline powered portable electrical generators.

Another factor which is desirable to be considered in the sweeping of magnetic influence mines from restricted areas, such as those earlier mentioned, is that magnetic influence mines are often polarized or directional in their sensitivity. Such a mine may be oriented to have maximum response only to a magnetic field generated by a coil lying in a particular plane, and considerably lesser response to magnetic fields generated by that coil when not in that plane. Because such mines are often laid by air drop, and may assume any of an endless variety of orientations when settled, it becomes probable that there will be mines that are so oriented that they will not be triggered by a magnetic field generated by a coil that does not lie in an appropriate plane with reference to those mines.

Of course, when clearing a minefield, some of the resulting explosions can be expected to destroy the sweeping apparatus. Accordingly, it is desirable to utilize apparatus that represents a minimum of expense and complexity.

SUMMARY OF THE INVENTION

The invention aims to overcome most or all of the aforementioned shortcomings of the prior art through the provision of an improved magnetic minesweeping system that employs a plurality of orthogonally disposed, large area coils or solenoids, that are energized to provide generation of magnetic fields appropriate to trigger magnetic influence mines irrespective of their orientation.

With the foregoing in mind, it is a principal object of the invention to provide an improved magnetic influence responsive minesweeping apparatus.

It is another object of the invention to provide an improved magnetic minesweeping system, having a magnetic coil assembly the framework of which is easily and economically constructed from relatively common, readily available materials.

Another object of the invention is the provision of a static magnetic coil assembly of the foregoing character that is stable when resting on the ground or, for example, across the gunwales of small boats, or rafts, pontoons, or the like, for use in detonating mines in shallow or restricted water.

Still another object is the provision of an improved method of sweeping magnetic influence mines having directional response and unknown orientation.

Yet another object is the provision of a three-axis minesweeping coil that is particularly uncomplicated and inexpensive, rendering it notably suitable for use as an expendable item in clearing large minefields, while replacements can be easily fabricated by relatively unskilled workers drawn from the area being cleared.

As a further object the invention aims to provide a three-axis coil assembly of the foregoing character that is constructed substantially entirely of non-magnetic materials, whereby the coil assembly can be carried to the edge of, or into a magnetic influence minefield with little danger of detonating a mine before the coil is energized.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
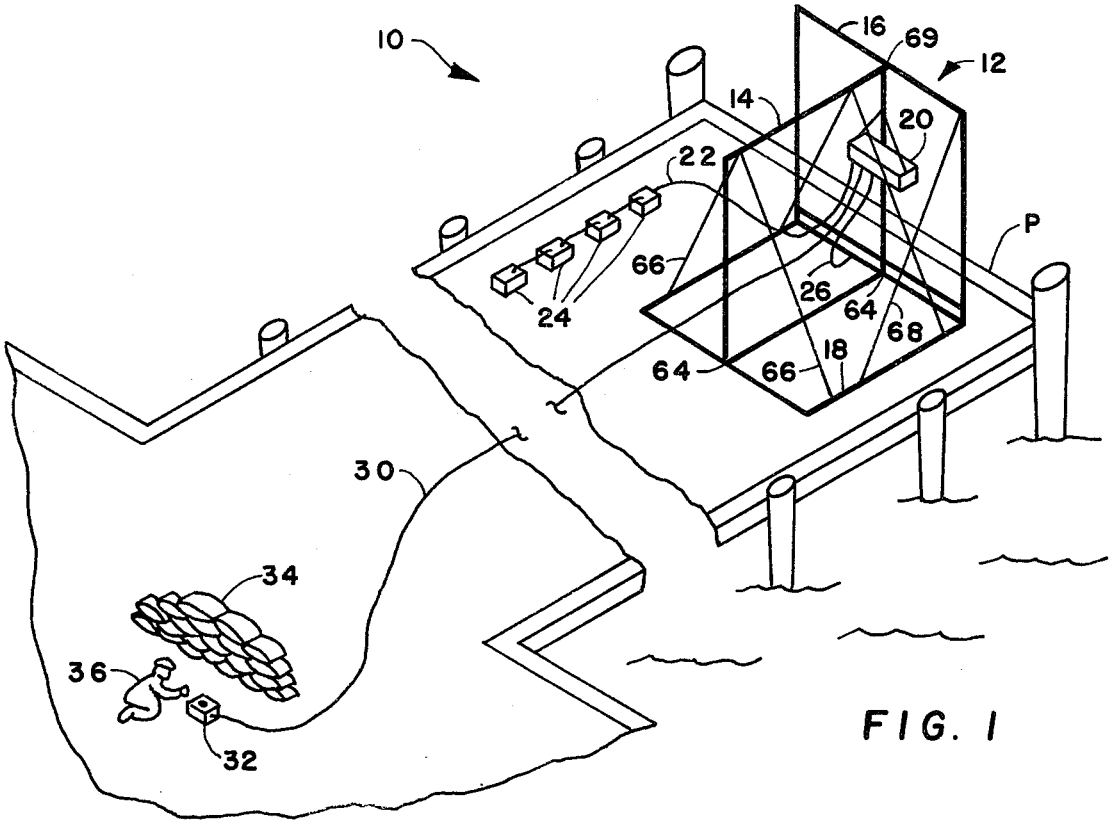
FIG. 1 is a perspective illustration of a magnetic influence minesweeping system embodying the invention, shown in an exemplary situation of use.

Referring to FIG. 1, a three-axis, static loop minesweeping system 10 is illustrated as it would be used in sweeping or detonating magnetic influence mines in dock spaces about a pier P. System 10 comprises a magnetic coil assembly 12 having three magnetic field inducing rectangular solenoid, air core coils 14, 16, and 18 each disposed in a plane that is orthogonal to the planes of the other two. Coils 14, 16 and 18 are supported by a framework, later described in more detail with reference to FIGS. 2 and 3, that is adapted to rest in a stable manner on most any generally horizontal surface such as presented by pier P.

Suspended from coil assembly 12 is an electrical pulse forming device 20 which is connected, as shown by cable 22, to receive electrical power from a group of storage batteries 24. Pulse forming device 20, which may comprise any suitable device for converting direct current from storage batteries 24 into pulses of alternating current, has its output connected, as shown by cable 26 to one of the rectangular coils 14, 16, and 18.

A control cable 30 leads from pulse forming device 22 to a control box 32 located behind a suitable protective barricade 34 at a distance that will afford safety from the explosive effects of any mine that may be actuated by system 10. An operator 36, behind barricade 34, manipulates control elements supported by box 32 so as to cause pulse forming device 20 to effect energization of one of the coils 14, 16, and 18 to which it is connected.

Figure 2:
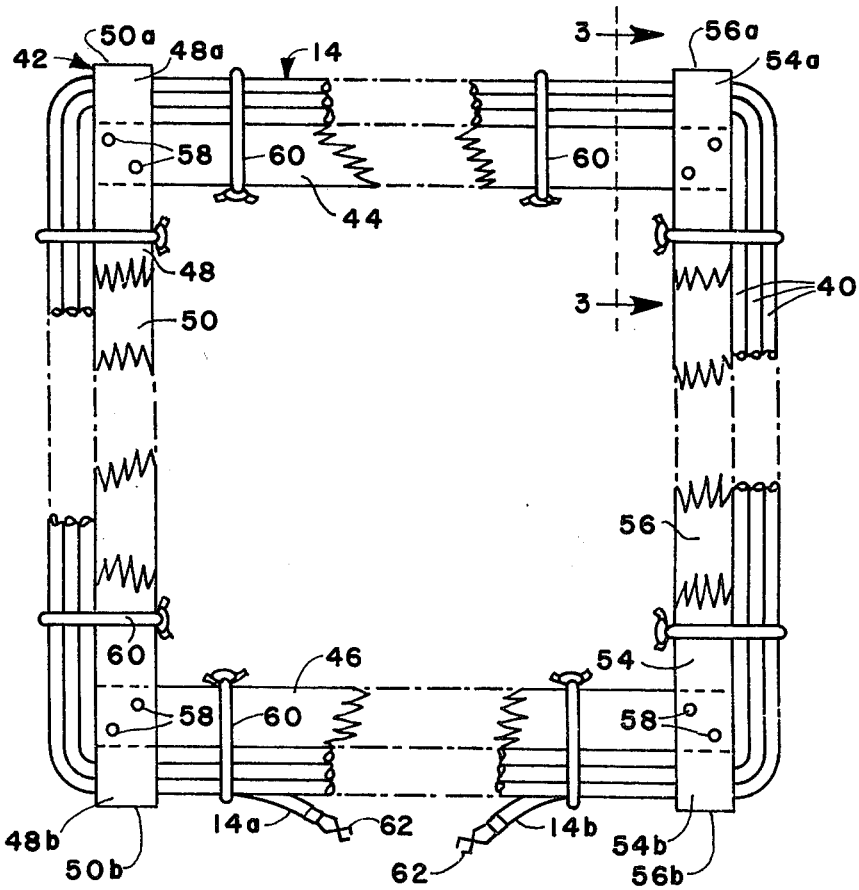
FIG. 2 is an enlarged elevational view of a coil and frame portion of the system of FIG. 1, with portions broken out for clarity.
Figure 3:
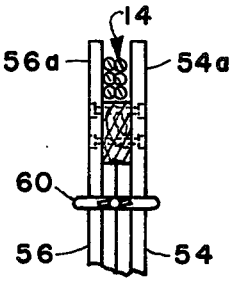
FIG. 3 is a fragmentary sectional view taken substantially along line 3-3 of FIG. 2.

Referring now to FIGS. 2 and 3, there will be described the construction of one coil 14, and its supporting structure forming part of coil assembly 12. Coil 14 comprises a plurality of turns or windings of insulated electric wire 40 supported on a coil frame 42 formed of wooden members, generally in the form of a square when viewed in elevation as in FIG. 2. Frame 42 comprises spaced parallel, nonmagnetic, beams or members 44 and 46, conveniently in the form of 2 by 4 inch lumber, having a length, in the practical embodiment being described, of about twelve feet.

One end of member 44 is connected to the like end of member 46 by non-magnetic beams or members 48 and 50, conveniently in the form of one by four inch lumber, approximately twelve feet in length. Members 48 and 50 are secured by nonmagnetic nails 52 to opposite sides of members 44 and 46 and have end portions 48*a*, 48*b* and 50*a*, 50*b* projecting several inches beyond the respective outer edges of members 44 and 46. Similarly, the opposite ends of members 44, 46 are connected by nonmagnetic beams or members 54 and 56, secured by nonmagnetic nails 58 to opposite sides of members 44 and 46, with projecting end portions 54*a*, 54*b* and 56*a*, 56*b*.

The projecting end portions, being spaced by the members 44, 46 serve to retain the turns of wire 40 at the four corners of the generally square frame 42, as is best illustrated in FIG. 3. Additional securing of wire 40 is conveniently effected intermediate the corners of frame 42 by simple lashings 60.

The turns of wire 40, forming coil 14, terminate in end portions 14*a*, 14*b* equipped with suitable connectors 62 for effecting connection to two wires of cable 26 from pulse forming device 20. In the present embodiment, each coil 14, 16, 18 comprises twenty turns or loops of insulated stranded aluminum wire of size AWG 6 although fewer turns are illustrated for the sake of clarity. Each coil is characterized by a large diameter or transverse dimensions in comparison to its axial length. The coils 14, 16, and 18 are their respective frames 42, are joined to form coil assembly 12 by nailing or lashing of the frames to one another in their illustrated orthogonal relationships, and by providing diagonal guys therebetween in the manner about to be described. This is best accomplished by laying one coil and frame, e.g., coil 18 and its frame 42 on the ground or other horizontal supporting surface. Coil 14 is then placed in a vertical position with its lower frame corners disposed at the centers of the spaced, parallel two by four beams of the frame of coil 18, and nailed or lashed thereto at locations indicated at 64 in FIG. 1. Diagonal guys 66, formed of rope or other nonmagnetic material, are then fixed between the upper horizontal members of frame 42 and the members parallel thereto of the frame of coil 18. Coil 14, and its frame, is thereby retained in a plane orthogonal to coil 18 and its frame.

Coil 16, and its frame, is then positioned in a vertical plane orthogonal to the planes of both of coils 14 and 18, and placed so that one upper corner of coil 14 is engaged by the center of the upper horizontal portion of coil 16 and its frame. Nails or lashings are then used to secure that relationship at 69, and one or more diagonal guys 68 are connected between coils 16 and 18 and their respective frames.

Pulse forming device 20 is then conveniently secured to coil assembly 12, preferably at a substantial height above ground because of the presence of some magnetic material therein, and electrical connections are made between device 20 and a selected one of coils 14, 16 and 18.

Figure 4:
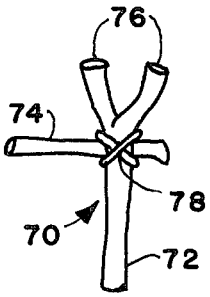
FIG. 4 is a fragmentary view of an alternative coil frame construction.

Referring to FIG. 4, a corner fragment of an alternate coil frame 70 is illustrated to show a manner of construction of coil assembly 12 from more rudimentary materials. Frame 70, which is generally square and of substantially the same overall dimensions as frame 42, comprises four side members, two of which are indicated at 72 and 74, cut from trees or saplings so as to have a forked end 76 that projects from each corner of the frame when the members are fastened together as by lashing 78. The forked ends 76 of frame members serve to retain the turns of wire of a coil wound thereon. Of course, additional retention can be had by serving or lashing the coils as described earlier. Three of the frames 70 and their respective coils are then assembled and fastened in mutually orthogonal planes in the same manner as described earlier with reference to coil assembly 12.

In operation, the coil assembly 12 is placed on a supporting surface, such as pier P, and electrical connections are made between batteries 24, A.C. pulse device 20, control box 32, and one of the coils 14, 16, and 18. Operator 36 manipulates a suitable switch on control box 32, causing pulse device 20 to energize a selected one of coils 14, 16 and 18, say coil 14, with pulses of alternating current. This causes a varying magnetic field to be set up having a principal axis extending horizontally through the center of the energized coil and normal to the plane thereof. Any magnetic mines, within the influence of the field so established, that are of sufficient sensitivity and appropriately oriented can be expected to be detonated.

If none are detonated, or if detonated have not damaged the system 10, another of the coils 14, 16, and 18, say coil 16, is energized to generate field having a principal axis extending horizontally therethrough and normal to the plane thereof. Again, if no mines are detonated, or if detonated and the system 10 is not damaged, the third coil 18 is energized to effect generation of a magnetic field having its principal axis extending vertically through that coil and normal to the plane thereof.

It will be recognized that the coil assembly 12, and the system 10 of which it is a part, when operated in the manner just described, produces three alternating polarity magnetic fields having mutually perpendicular principal axes, whereby magnetic influence mines within these fields are likely to be detonated irrespective of their physical orientation. It will further be recognized that the invention avoids the need of complex coil maneuvering mechanisms to produce the desired magnetic fields of differing axes, and does so with a unique, manually transportable assembly that can be constructed in the field with a minimum of supplies and tools.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A magnetic influence minesweeping system comprising in combination:

a coil assembly including first, second, and third open, rectangular solenoid coils fastened together so as to lie in three, mutually orthogonal planes including a horizontal plane and two vertical planes;

a source of direct current electrical voltage;

pulse supply means, connected to said source of direct current electrical voltage and to said coil assembly, for providing pulses of alternating current voltage to said solenoid coils; and control means, connected to said pulse supply means, for initiating said pulses from a position remote from said coil assembly.

2. A magnetic influence minesweeping system as defined in claim 1, and wherein said coil assembly further comprises:

first, second, and third rectangular coil frames supporting said first, second, and third solenoid coils, respectively;

each of said coil frames comprising a plurality of substantially equal length elongated wood members fixed together at their ends in the form of a square; and fastening means, interconnecting said coil frames, for securing thereof in mutually orthogonal relation.

3. A magnetic influence minesweeping system as defined in claim 2, and wherein said coil assembly means further comprises:

a plurality of guy lines, each extending diagonally from one of said elongated wood members of one of said coil frames to one of said elongated wood members of another of said coil frames.

4. A method of sweeping magnetic influence mines that are directional in sensitivity and are of unknown orientation, said method comprising the steps of:

providing first, second, and third air core solenoid coils of large transverse dimensions compared with axial length and disposed in mutually orthogonal planes;

energizing said first air core solenoid coil for a first predetermined time period with alternating electrical current to generate a first magnetic field having a first principal axis;

energizing said second air core solenoid coil for a second predetermined time period with alternating electrical current to generate a second magnetic field having a second principal axis perpendicular to said first principal axis; and energizing said third air core solenoid coil for a third predetermined time period with alternating electrical current to generate a third magnetic field having a third principal axis perpendicular to each of said first and second principal axes.

* * * * *